US005788993A

United States Patent [19]

Bryner et al.

[11] Patent Number: 5,788,993

[45] Date of Patent: Aug. 4, 1998

[54] SPINNERET WITH SLOTTED OUTLET

[75] Inventors: Michael Allen Bryner, Midlothian, Va.; Don M. Coates, Santa Fe, N. Mex.; Michael Charles Davis, Richmond, Va.; Tom Edward Estep, Chesterfield, Va.; Ralph A. Franke, Richmond, Va.; Larry Ray Marshall, Chesterfield, Va.; Subhra K. Nath, Midlothian, Va.; Charles Wesley Starke, Sr., Richmond, Va.

[73] Assignee: E. I. du Pont de Nemours and Company, Wilmington, Del.

[21] Appl. No.: 870,995

[22] Filed: Jun. 6, 1997

Related U.S. Application Data

[60] Provisional application No. 60/021,972, Jun. 27, 1996.

[51] Int. Cl.[6] ..... B28B 5/00

[52] U.S. Cl. ..... 425/72.2; 425/461; 264/204

[58] Field of Search ..... 264/140, 12, 204, 264/205; 425/461, 72.2

[56] References Cited

U.S. PATENT DOCUMENTS

| | | | |
|---|---|---|---|
| 2,367,451 | 1/1945 | West | 425/461 |
| 3,081,519 | 3/1963 | Blades et al. | 28/81 |
| 3,227,794 | 1/1966 | Anderson et al. | 264/205 |
| 3,315,020 | 4/1967 | Gore | 425/461 |
| 3,484,899 | 12/1969 | Smith . | |
| 3,689,608 | 9/1972 | Herbert et al. | 264/24 |
| 3,756,441 | 9/1973 | Anderson et al. . | |
| 4,025,593 | 5/1977 | Raganato et al. | 264/12 |
| 4,179,875 | 12/1979 | Gibbon | 57/248 |
| 4,189,455 | 2/1980 | Raganato et al. | 264/12 |
| 4,352,650 | 10/1982 | Marshall | 425/174.8 |
| 4,642,262 | 2/1987 | Piotrowski et al. | 264/12 |
| 5,192,468 | 3/1993 | Coates et al. | 264/13 |
| 5,279,776 | 1/1994 | Shah | 264/12 |
| 5,415,818 | 5/1995 | Cloutier et al. | 264/140 |

*Primary Examiner*—Jay H. Woo
*Assistant Examiner*—Robert Hopkins

[57] ABSTRACT

A flash spin pack for a flash-spinning apparatus is provided in which the pack includes a spin mixture inlet, that communicates with a spin mixture passage, that discharges through a spinning orifice that opens into a slot defined by two opposing faces of the body of the spin pack. The slot is 0.25 mm to 7 mm wide proximate the spinning orifice outlet, 0.25 mm to 10 mm at the slot outlet, and the distance from the orifice outlet to the slot outlet is 1.5 mm to 40 mm. The spin pack may have five or more spinning orifices that each discharge into a different slot so configured.

9 Claims, 4 Drawing Sheets

SPINNERET WITH SLOTTED OUTLET

This application claims the benefit of U.S. Provisional Application No. 60/021,972, filed on Jun. 27, 1996.

FIELD OF THE INVENTION

This invention relates to an apparatus for producing synthetic plexifilamentary material and more particularly to a spinneret for flash-spinning a polymeric plexifilamentary web.

BACKGROUND OF THE INVENTION

The art of flash-spinning or flash-extruding plexifilamentary film-fibrils from a polymer in a solution or a dispersion is known in the art. The term "plexifilamentary" means a three-dimensional integral network of a multitude of thin, ribbon-like, film-fibril elements of random length and with a mean thickness of less than about 4 microns and a median fiber width of less than about 25 microns. In plexifilamentary structures, the film-fibril elements are generally coextensively aligned with the longitudinal axis of the structure and they intermittently unite and separate at irregular intervals in various places throughout the length, width and thickness of the structure to form the three-dimensional network.

U.S. Pat. No. 3,081,519 to Blades and White (assigned to E. I. du Pont de Nemours & Company ("DuPont")) describes a process wherein a polymer in solution is forwarded continuously to a spin orifice at a temperature above the boiling point of the solvent, and at autogenous pressure or greater, and is flash-spun into a zone of lower temperature and substantially lower pressure to generate a strand of plexifilamentary material. U.S. Pat. No. 5,192,468 to Coates et al. (assigned to DuPont) discloses another process for flash-spinning a plexifilamentary strand according to which a mechanically generated dispersion of melt-spinnable polymer, carbon dioxide and water under high pressure is flashed through a spin orifice into a zone of substantially lower temperature and pressure to form the plexifilamentary strand.

U.S. Pat. No. 3,227,794 to Anderson et al. (assigned to DuPont) teaches that plexifilamentary film-fibrils are best obtained when the pressure of the polymer and spin agent is reduced slightly to a pressure below the solution phase boundary in a preflashing letdown chamber prior to entering the spin orifice. Reduction of flow pressure causes separation of a second phase which has been found to be beneficial in producing desired plexifilamentary strands. The passage of the pressurized polymer and spin agent from the letdown chamber into the spin orifice generates an extensional flow at the orifice that helps to orient the polymer chains. When polymer and spin agent discharge from the orifice, the spin agent rapidly vaporizes and expands to leave behind fibrillated plexifilamentary film-fibrils. The spin agent's expansion during flashing accelerates the polymer so as to further stretch the polymer molecules just as the film-fibrils are being formed and the polymer is being cooled by the adiabatic expansion. The quenching of the polymer freezes the linear orientation of the polymer molecule chains in place, which contributes to the strength of the resulting flash-spun plexifilamentary polymer structure.

U.S. Pat. No. 3,484,899 to Smith (assigned to DuPont) discloses a known flash-spinning apparatus. This patent describes a horizontally oriented spin orifice with a cylindrical tunnel immediately downstream of the orifice through which a plexifilamentary strand can be flash-spun. Flashing within the confined tunnel helps accelerate the polymer strand so as to stretch the polymer as it cools. U.S. Pat. No. 4,352,650 to Marshall (assigned to DuPont) discloses that the tunnel can be flared in a manner that improves strength and reduces defects in the flash-spun plexifilamentary product. The polymer strand discharged from the tunnel is conventionally directed against a rotating lobed deflector baffle. The rotating baffle spreads the strand into a more planar web structure that the baffle alternately directs to the left and right. As the spread web descends from the baffle, the web is passed through an electric corona generated charging zone between an ion gun and a target plate. The corona charges the web so as to hold it in a spread open configuration as the web descends to a moving belt. The belt is grounded to help insure proper pinning of the charged web on the belt. A fibrous sheet is formed on the belt that has plexifilamentary film-fibril networks oriented in an overlapping multi-directional configuration. The fibrous sheets may be bonded for use in wall coverings, air infiltration barrier sheets, envelopes, soft textile-like nonwoven fabrics, and substrates for various coatings and laminates.

The known apparatus for flash-spinning plexifilamentary film-fibrils and spreading such fibers for laydown on a moving belt, as described above, requires constant monitoring and maintenance. Problems with the rotating baffle and its drive mechanism, and polymer build-up on the rotating baffle, the ion gun, the target plate, and auxilary equipment, all require regular maintenance. The space requirements for the known rotating baffle spinning apparatus and its relatively wide web laydown pattern make close spacing of such spinnerets difficult to achieve. Accordingly, there is a need for a simpler apparatus capable of both flash-spinning plexifilamentary film-fibrils and spreading such plexifilamentary film-fibrils into a thin web structure in a single step.

SUMMARY OF THE INVENTION

There is provided by this invention a flash spin pack for a flash-spinning apparatus. The spin pack has a spin pack body with a spin mixture inlet, and a spin mixture passage with first and second ends, the first end of which is in communication with said spin mixture inlet. A spinning orifice with a cross-sectional area in the range of 0.0025 $mm^2$ to 32 $mm^2$, has an inlet that is in communication with the second end of the spin mixture passage. The outlet of the spinning orifice opens into a slot defined by two opposing faces of the spin pack body. The distance between the opposing faces that define the slot is within the range of 0.25 mm to 7 mm proximate the spinning orifice outlet. The two opposing faces of the slot form a slot outlet, and the distance from said spinning orifice outlet to any portion of said slot outlet is within the range of 1.5 mm to 40 mm. The distance between the opposing faces at the slot outlet is within the range of 0.25 mm to 10 mm.

Heating elements may be incorporated into the spin pack body for the purpose of maintaining the temperature of the spin pack body at a desired spinning temperature. Preferably the slot outlet of the spin pack has a substantially semicircular shape that is centered about the spinning orifice outlet. The opposing faces of the slot may be oriented to diverge from each other at an angle between 0.5° and 5° between the outlet of the spinning orifice and the outlet of the slot.

In one embodiment of the invention, the spin pack has a multiplicity of spinning orifices that each discharge into a different slot configured like the slots described above. Preferably, the spinning orifices point in the same direction and are spaced from adjacent orifices at substantially equal intervals along a straight line. Each of the plurality of slots defines a central plane that is spaced equally between the opposing faces of the slot, such that the central plane of each of the slots is parallel to the central planes of the other slots, and the centerline of each spinning orifice is on the central plane of the respective slot. An angle is formed between the central plane of each of the slots and a plane passing through the centerline of each of said spinning orifices, and this angle is preferably within the range of 5° to 45°.

BRIEF DESCRIPTION OF THE DRAWINGS

The accompanying drawings, which are incorporated in and constitute a part of this specification, illustrate the presently preferred embodiments of the invention and, together with the description, serve to explain the principles of the invention.

DETAILED DESCRIPTION OF THE INVENTION

Figure 1:
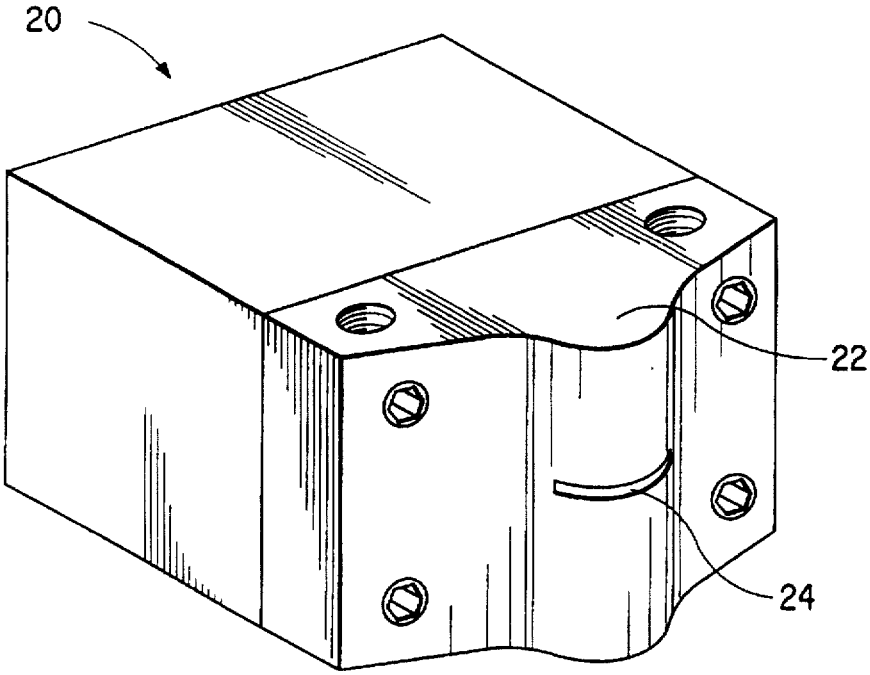
FIG. 1 is a perspective view of a spin pack made in accordance with a preferred embodiment of the invention.

Reference will now be made in detail to the presently preferred embodiments of the invention, examples of which are illustrated in the accompanying drawings. Throughout the drawings, like reference characters are used to designate like elements.

Figure 2:
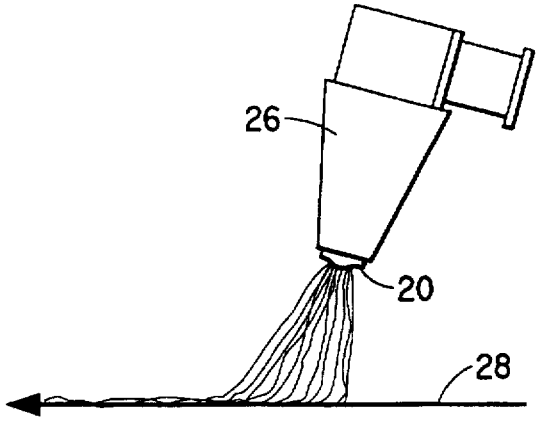
FIG. 2 is a schematic view of a flash spinning apparatus, including the spin pack of FIG. 1, that is shown in the process of flash spinning a plexifilamentary web onto a moving belt.
Figure 3:
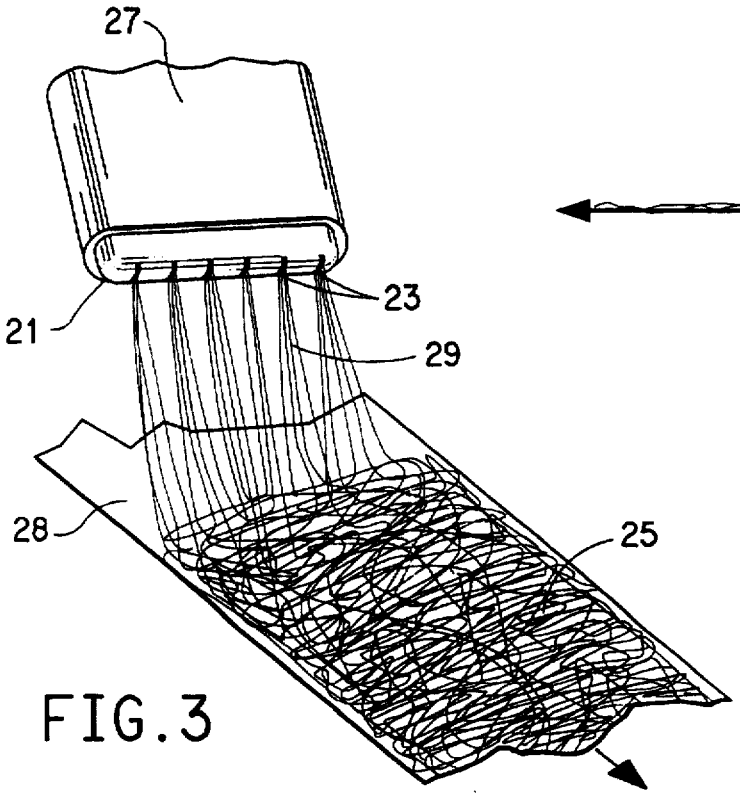
FIG. 3 is a schematic view of a flash spinning apparatus, including an alternative spin pack, that is shown in the process of flash spinning multiple plexifilamentary webs onto a moving belt.

In FIG. 1, a spinneret pack 20 for flash-spinning a plexifilamentary web is illustrated. The pack 20 is preferably made of a high strength alloy such as T316 Stainless Steel. Pack 20 includes an elongated outwardly contoured portion 22 with a semicircular slot opening 24 therein. Spin pack 20 is mountable on the end of a flash spinning apparatus 26, as shown in FIG. 2, that is similar to the spinning apparatus disclosed in U.S. Pat. No. 3,484,899 to Smith. Spinning apparatus 26 is preferably mounted above a moving belt 28 such that plexifilamentary material spun from spin pack 20 can be collected on moving belt 28. In FIG. 3, an alternative spin pack 21, with multiple spinning slots 23, is shown mounted on a spinning apparatus 27 above a belt 28.

Figure 4:
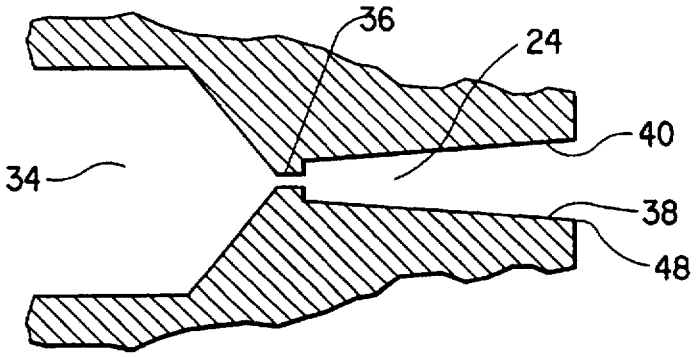
FIG. 4 is a cross-sectional side view showing the spin orifice and slot of the spin pack shown in FIG. 1.
Figure 5:
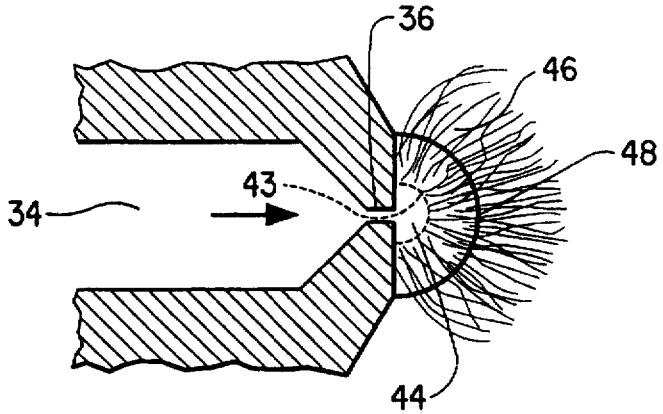
FIG. 5 is a cross-sectional top view of the spin orifice and slot of the spin pack of FIG. 1 shown in the process of spinning a plexifilamentary web.
Figure 6:
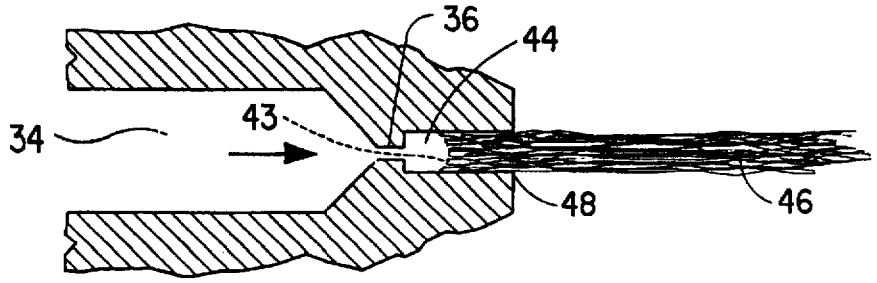
FIG. 6 is a cross-sectional side view of the spin orifice and slot of FIG. 5.

Cross-sectional views of the slot 24 are shown in FIGS. 4–6. The following description of the slot 24 also describes the individual slots 23 of the spin pack 21 shown in FIG. 3. In the spinneret of the invention, a slot is positioned immediately downstream of a substantially cylindrical spinning orifice 36 like the orifice of U.S. Pat. No. 4,352,650 to Marshall, which is hereby incorporated by reference. As can be seen in FIG. 4, slot 24 is defined by opposite faces 38 and 40. Faces 38 and 40 may be parallel to each other or they may diverge from each other such that the width of slot 24 increases with distance from spin orifice 36, as is shown in FIG. 4. Faces 38 and 40 may be flat or convex. The space between faces 38 and 40 of slot 24 should be narrow enough to distort the pressure field of a pressurized mixture of polymer and spin agent discharging from spin orifice 36 and expanding within the slot 24.

As a polymer and spin agent mixture enters the slot 24, the mixture expands into a larger area and the pressure of the mixture decreases. Upon entering slot 24, the spin agent begins to expand, but the expansion is constrained by the slot faces 38 and 40 such that a film of the mixture of polymer and spin agent is pushed radially outward in a fan-like pattern. The mixture begins its fan-like expansion in a liquid state within the zone 44, as can be seen in FIGS. 5 and 6. As expansion proceeds, the pressure decreases until an interface 43 is reached at which point the spin agent begins to vaporize and polymer fibrils begin to form. As the spin agent continues its rapid fan-like expansion, the mixture's pressure continues to decrease which generates greater expansion and flash vaporization of the spin agent. This, in turn, promotes the formation of polymer plexifilamentary film-fibrils and accelerates and stretches the fibrils as they are forming. In a single step, the web of plexifilamentary film-fibrils is formed and spread. As can be seen in the side view shown in FIG. 6, the plexifilamentary web remains thin as it spreads. The fan-like spreading of the plexifilamentary film-fibrils continues for a short period after the web passes the outer semicircular opening edge 48 of slot 24.

If the slot 24 diverges too quickly, the polymer and spin agent mixture exiting the orifice will maintain the cylindrical shape of orifice 36 as it passes through the slot 24. If, on the other hand, faces 38 and 40 are too close, plugging of slot 24 is likely, especially at higher throughputs. In the preferred embodiment of the invention, the slot faces diverge from each other at an angle of approximately 0.5° to 5° in order to prevent sticking or spitting of polymer. The faces 38 and 40 may also be highly polished or they may be coated with a non-stick coating such as a TEFLON® non-stick finish to reduce sticking and spitting of the polymer. TEFLON® is a registered trademark of DuPont. In the preferred embodiment of the invention, the distance between faces 38 and 40 proximate the opening of spinning orifice 36 is about 0.9 mm while the distance between the faces 38 and 40 at the opening edge 48 of slot 24 is about 1.4 mm. Preferably, the distance from the opening of orifice 36 to the outer opening edge 48 of slot 24 is between about 5 and 15 mm. It is also preferred that the area of the opening of slot 24 be between 100 and 130 times the cross-sectional area of the opening of orifice 36.

Figure 7:
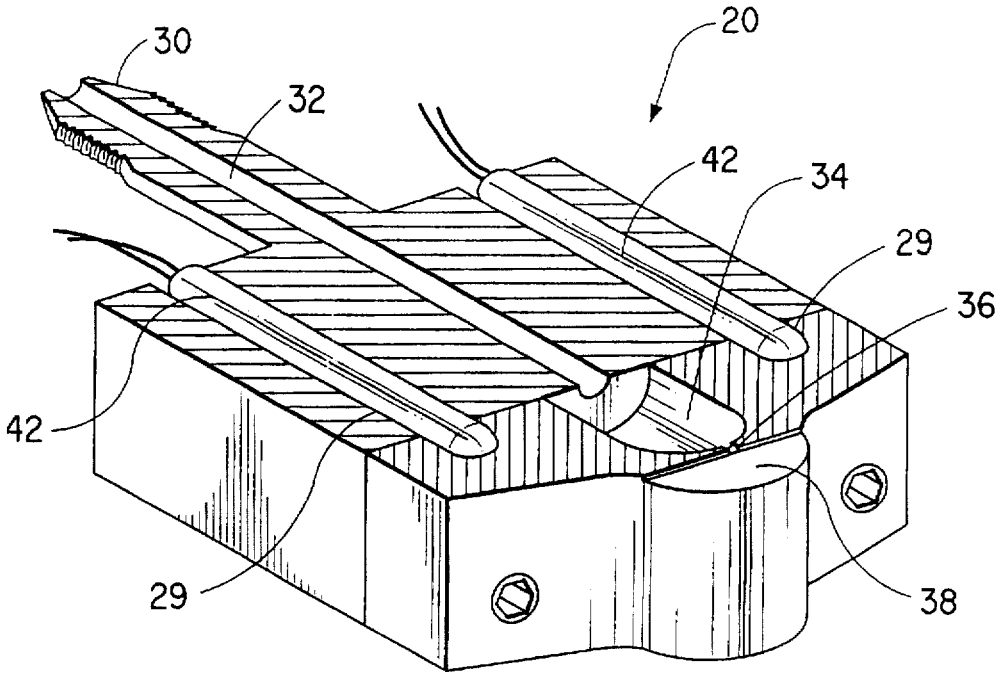
FIG. 7 is a cross-sectional perspective view of the spin pack shown in FIG. 1.

FIG. 7 is a perspective cross-sectional view of spin pack 20 into which a spin orifice and slot, like that described above with reference to FIGS. 4–6, are incorporated. Pack 20 includes a high pressure connector 30 that mounts on spinning apparatus 26. Preferably connector 30 comprises a metal-to-metal tapered conical seat held in place by a threaded coupling. A passage 32 in connector 30 supplies polymer and spin agent to a chamber 34. Passage 32 preferably has a diameter between about 6 and 9 mm, and a length of between about 100 and 150 mm. Preferably, chamber 34 has a diameter at least several times that of the diameter of passage 32. For example, chamber 34 may be cylindrically shaped with a tapered end opposite the chamber inlet and the chamber may have a diameter between 15 and 20 mm. The volume of chamber 34 is preferably about 3500 $mm^3$.

Figure 8:
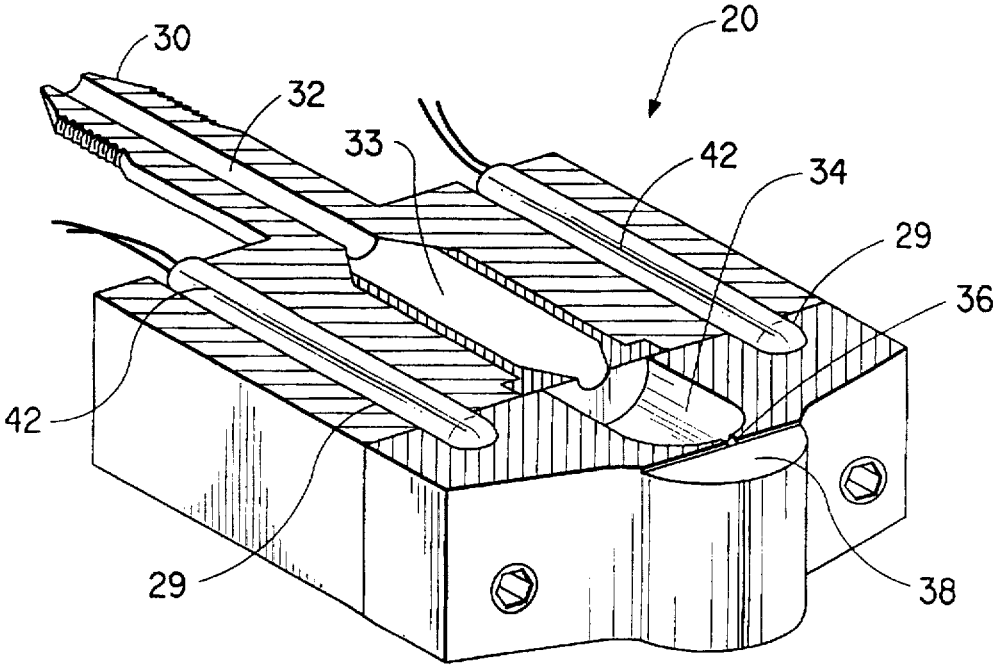
FIG. 8 is a cross-sectional perspective view of an alternative embodiment of the spin pack shown in FIG. 7.

Chamber 34 of spin pack 20 may act as a letdown chamber in systems where a polymer is flash-spun from a solution as described in U.S. Pat. No. 3,227,794 to Anderson et al. In such solution flash-spinning systems, the polymer enters chamber 34 in solution, but the reduced pressure within the chamber 34 promotes nucleation of a very fine dispersion of solvent in the polymer solution that facilitates formation of plexifilamentary strands upon being spun through an orifice. Chamber 34 provides a constant flow of the mixture of polymer and spin agent into the spin orifice during flash-spinning. When a mixture of polymer and spin agent enters the chamber 34, the pressure of the mixture drops. The pressure of the mixture within the chamber 34 depends on the polymer, the spin agent, and the spinning process used. In some systems the pressure within chamber 34 may be as low as 5000 kPa, while in other systems the pressure may be as high as 35,000 kPa. A second upstream chamber 33, as shown in FIG. 8, may be added to the spin pack to serve as a site for a polymer filter or a static mixing device. One static mixing device that has been beneficially used in conjunction with the invention is a static mixer comprised of Model SMX mixing elements that have been welded together, as sold by Koch Engineering Company, Inc. of Wichita, Kans.

The faces 38 and 40 of the slot may be maintained at an elevated temperature by a plurality of heating elements 42 that are inserted in the bore holes 29 of the pack 20. As shown in FIG. 7, the heating elements 42 may be ⅜ inch diameter 400 joule/sec electrical resistance heating elements manufactured by Watlow, Inc. of Saint Louis, Mo. Alternatively, the spin pack may be heated with steam that circulates through steam passages in the spin pack. When the spin pack 20 is in operation, the heating elements 42 counter the cooling that arises from the adiabatic expansion of spin agent in slot 24. Preferably, heating elements prevent polymer sticking by keeping the temperature of the pack at a temperature higher than the melting point of the polymer being spun.

Figure 9:
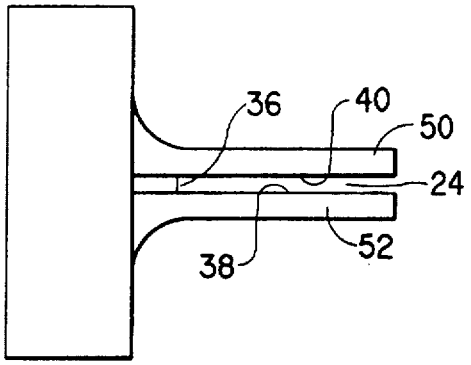
FIG. 9 is a side view of a schematic representation of a spinning slot according to one alternative embodiment of the invention.
Figure 10:
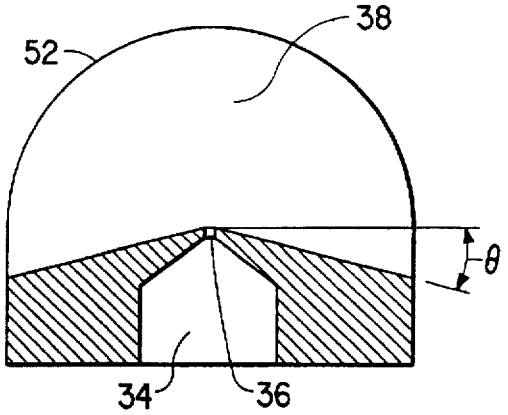
FIG. 10 is a cross-sectional downward view of the spinning slot shown in FIG. 9.
Figure 11:
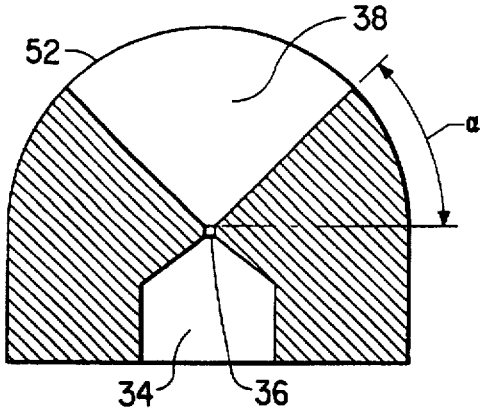
FIG. 11 is a cross-sectional downward view of a spinning slot according to another alternative embodiment of the invention.

In the alternative embodiment of the invention shown in FIGS. 9 and 10, slot 24 is formed between projecting shields rather than being formed in an outwardly extending contour of the spin pack 20 (as shown in FIG. 1). The spin slot shown in FIGS. 9 and 10 would be expected to perform satisfactorily in the spinning of polymers with low melting points where cooling of the faces 38 and 40 is less likely to result in polymer sticking. FIG. 9 shows a side view and FIG. 10 shows a downward cross-sectional view of this alternative embodiment. The slot 24 is formed between parallel faces 38 and 40, and the slot is angled back from the spin orifice 36 at an angle θ, so as to facilitate greater spreading of a web spun from the spin orifice. In the event that reduced web spreading is desired, a slot tapered at an angle α, as shown in FIG. 11, can be used. The angled geometries of the slot 24, as shown in FIGS. 10 and 11, could be incorporated into the spin pack embodiment shown in FIG. 1. Likewise, the diverging opposing faces that define the slot 24 shown in FIG. 4 could be incorporated into the embodiments of the invention shown in FIGS. 10 and 11.

The spinning slots of FIGS. 4, 10 and 11 can also be used in spin packs having multiple spinning slots. As shown in FIG. 3, multiple spinning slots 23, each similar to slot 24 of FIG. 4, can be combined in an elongated spin pack 21. In an another embodiment of a multiple slot spin pack 21, the slots of the pack can simply be parallel cuts into a rounded surface of a bar wherein the bar fits over a line of spin orifices and each orifice opens into a corresponding slot. Slots 23 are preferably arranged in an offset and parallel fashion as shown in FIG. 3. The thin nature of the plexifilamentary web spun from each slot makes it possible to position adjacent slots close enough to each other that the web spun from each slot overlaps the web spun from the adjacent slot so as to form a continuous curtain 29. The plexifilamentary curtain can be laid down on a moving belt 28 to form a continuous sheet 25 of plexifilamentary material. Each of the slots 23 in spin pack 21 receives polymer and spin agent through a spin orifice similar to the orifice 36 of FIG. 4. Likewise, each spin orifice in the elongated spin pack 21 preferably receives polymer and spin agent from a chamber 34. In some instances, it may be desirable to have a single chamber connected to multiple spin orifices.

Figure 12:
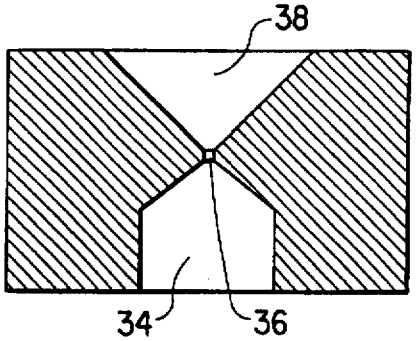
FIG. 12 is a cross-sectional downward view of a spinning slot according to another alternative embodiment of the invention.

To counteract the high degree of cooling associated with multiple spinning slots 23, resistance heating elements or steam heating conduits, as discussed above, may be incorporated into the elongated spin pack 21 to help prevent polymer from sticking to the faces of the slots. In order to keep the faces of the slots above the melting temperature of the polymer being spun, more readily heatable fully internal slots, like those shown in FIG. 12, may be incorporated into the elongated spin pack 21. Such internal slots should be especially effective in spin packs having a large number of very small spinning slots. While the internal edges of the slot 38 are shown as straight edges in FIGS. 10, 11 and 12, the internal edges of slot 38 may be curved or otherwise contoured to obtain a desired web distribution.

EXAMPLES

The operation of the spinning orifice and slot of the invention will be described in the illustrative examples that follow. The spinning packs described above, were used in the following non-limiting examples which are intended to illustrate the invention and not to limit the invention in any manner.

Spin Product Test Procedures

The denier of the web is determined from the weight of a 15 cm sample length of web.

Tenacity, elongation and toughness of the flash-spun web are determined with an Instron tensile-testing machine. The webs are conditioned and tested at 70° F. and 65% relative humidity. The webs are then twisted to 10 turns per inch and mounted in the jaws of the Instron tester. A 2 inch (5.08 cm) length was used with an initial elongation rate was 4 inches per minute (10.16 cm/min). The tenacity at break is recorded in grams per denier (gpd). The elongation at break is recorded as a percentage of the original gauge length of the sample. Toughness is a measure of the work required to break the sample divided by the denier of the sample and is recorded in gpd.

Fiber quality is evaluated using a subjective scale of 0 to 3, with a 3 being the highest quality rating. Under the evaluation procedure, a 10 inch length of a plexifilamentary web is removed from a fiber batt. The web is spread and mounted on a dark substrate. The fiber quality rating is an average of three subjective ratings, one for fineness of the fiber (finer fibers receive higher ratings), one for the continuity of the fiber web (continuous plexifilamentary webs receive a higher rating), and the other for the frequency of the ties (more networked plexifilamentary webs receive a higher rating).

Basis Weight measures weight per unit area according to ASTM D-3776 and is reported in $g/m^2$. The basis weights reported for the examples below are each based on an average of at least twelve measurements made on the sample.

Mass Deposition Uniformity was determined by measuring the average mass of the sheet with a beta gauge over an area of approximately 1 $cm^2$. The mass deposition uniformity value ($\sigma$) represents the statistical standard deviation of the measured mass values. A lower standard deviation is indicative of a more uniform sheet. The coefficient of variation is equal to 100($\sigma$/avg. basis weight).

EXAMPLE 1

A plexifilamentary web comprised of ALATHON® H6018 and SELAR® OH BX240 was spun from a spin pack like that shown in FIGS. 1 and 7. ALATHON® H6018 is a high density polyethylene that was obtained from Occidental Chemical Corporation of Houston, Tex. ALATHON® is a registered trademark of Lyondell Petrochemical Company of Houston, Tex. The ALATHON® H6018 had a melt flow rate of 17.5 g/10 min by standard techniques at a temperature of 190° C. with a 2.16 Kg weight, and had a melting point of 130°–135° C. The SELAR® OH BX240 was obtained from DuPont. SELAR® is a registered trademark of DuPont. SELAR® OH BX240 is a melt-blended, pelletized polymer consisting of 90% SELAR® OH 4416 and 10% FUSABOND® E MB-259D, both polymers being obtained from DuPont. FUSABOND® is a registered trademark of DuPont Canada. SELAR® OH 4416 is an ethylene vinyl alcohol copolymer having 44 mole % ethylene units, a melt flow rate of 16.0 g/10 min by standard techniques at a temperature of 210° C. with a 2.16 kg weight, and a melting point of 168° C. FUSABOND® E MB-259D is a polyethylene grafted with 0.2–0.3% maleic anhydride, with a melt flow rate of 20–25 g/10 min by standard techniques at a temperature of 190° C. with a 2.16 kg weight, and with a melting point of 120°–122° C.

A polymer blend of 90% ALATHON® H6018 and 10% SELAR® OH BX240 was continuously heat extruded and injected under pressure into a high shear continuous rotary mixer. Inside the mixer, the polymer blend was plasticized with supercritical $CO_2$ and was mixed with water. The mixing ratio of $CO_2$ to polymer (by weight) was maintained at approximately 1.2. The mixing ratio of water to polymer (by weight) was maintained at approximately 0.9. The polymer, $CO_2$ and water mixture was maintained within the mixer at a pressure of approximately 30,000 kPa and at a temperature of approximately 220° C.

After approximately 11 seconds of mixing, the mixture was transferred through a heated and insulated transfer line to a spin pack like that shown in FIGS. 1 and 7. A 200 micron filter was placed in the transfer line between the mixer outlet and the spin pack. The mixture was fed into a 3,930 $mm^3$ chamber in the spin pack and then through the pack's spin orifice. The spin orifice had a diameter of 0.79 mm and a length to diameter ratio of 0.23. The distance between the opposite faces of the spin pack slot proximate the spin pack orifice was 0.91 mm. At the exit opening of the slot, the distance between the faces was 1.14 mm. The distance from the spin orifice to the exit opening of the spin pack slot was 9.55 mm. The pressure of the mixture in the spin pack chamber was about 28,000 kPa.

A collapsed tubular web of finely fibrillated, soft plexifilamentary strands was continuously spun from the slot during a production period lasting approximately 15 minutes. The web was laid down directly on a moving belt without passing through an electric corona. The web was 30 to 40 cm wide with occasional holes and breaks. The web had a tex of approximately 100 and the web's tenacity was approximately 0.6 gpd.

EXAMPLE 2

A plexifilamentary web comprised of a blend of 50% CRASTIN® 6131 polyester, 35% CRASTIN® 6130 polyester, 5% HYTREL® 6133 polyether ester, and 10% Valtec HH444 polypropylene was spun from a spin pack like that shown in FIGS. 1 and 8. CRASTIN® 6131 is a non-reinforced low molecular weight 4GT polyester obtained from DuPont. CRASTIN® is a registered trademark of DuPont. CRASTIN® 6131 was formerly sold under the name RYNITE® 6131. CRASTIN® 6131 has a melt flow rate of 42 g/10 min by standard techniques at a temperature of 250° C. with a 2.16 kg weight, and has a melting point of 225° C. CRASTIN® 6130 is a non-reinforced 4GT polyester obtained from DuPont that has a higher molecular weight than CRASTIN® 6131. CRASTIN® 6130 has a melt flow rate of 12.5 g/10 min by standard techniques at a temperature of 250° C. with a 2.16 kg weight, and has a melting point of 225° C. HYTREL® 6133 is a melt spinnable polyether ester block copolymer obtained from DuPont. HYTREL® is a registered trademark of DuPont. HYTREL® has a melt flow rate of 5.0 g/10 min by standard techniques at a temperature of 190° C. with a 2.16 kg weight, and it has a melting point in the range of 170°–190° C. Valtec HH444 is a melt spinnable polypropylene obtained from Himont Corporation of Wilmington, Del. Valtec HH444 has a melt flow rate of 70 g/10 min by standard techniques at a temperature of 190° C. with a 2.16 kg weight, and has a melting point of 170° C.

The polymer blend of 50% CRASTIN® 6131 polyester, 35% CRASTIN® 6130 polyester, 5% HYTREL® 6133 polyether ester, and 10% Valtec HH444 polypropylene was continuously heat extruded and injected under pressure into a high shear continuous rotary mixer during a production period that lasted approximately 15 minutes. Inside the mixer, the polymer blend was plasticized with supercritical $CO_2$ and was mixed with water. The mixing ratio of polymer to $CO_2$ (by weight) was maintained at approximately 1.25. The mixing ratio of polymer to water (by weight) was maintained at approximately 2.86. The polymer, $CO_2$ and water mixture was maintained within the mixer at a pressure of approximately 29,000 kPa and at a temperature of approximately 235° C.

After approximately 11 seconds of mixing, the mixture was transferred through a heated and insulated transfer line to a spin pack like that shown in FIGS. 1 and 8. A 440 micron filter was placed in the transfer line between the mixer outlet and the spin pack. The mixture was fed into a 3,930 $mm^3$ chamber in the spin pack where it passed through a four element in-line static mixer placed approximately 3.2 cm (1.25 in) upstream of the spin orifice. The static mixer had a cylindrical sleeve that held four Model SMX static mixing elements that had been welded together to form a mixing insert, as sold by Koch Engineering Company, Inc. of Wichita, Kans. The spin orifice had a diameter of 0.79 mm and a length to diameter ratio of 0.31. The distance between the opposite faces of the spin pack slot proximate the spin pack orifice was 1.35 mm. At the exit opening of the slot the distance between the faces was 1.75 mm. The distance from the spin orifice to the exit opening of the spin pack slot was 12.75 mm. The pressure of the mixture in the spin pack chamber was about 29,000 kPa.

A finely fibrillated plexifilamentary web was continuously spun from the slot during the 15 minute production period. The web was laid down directly on a moving belt without passing through an electric corona. The web was about 40 cm wide, it had a tenacity of 2.6 gpd, an elongation of 37%, a toughness of 0.6 gpd, and a fiber quality rating of 2.5.

EXAMPLE 3

A plexifilamentary web comprised of a blend of 100% ALATHON® 7026 high density polyethylene was flash-spun from a 14 nozzle spin pack similar to the spin pack shown in FIG. 3. ALATHON® 7026 was obtained from Occidental Chemical Corporation of Houston, Tex. ALATHON® is a registered trademark of Lyondell Petrochemical Company of Houston, Tex. ALATHON® 7026 has a density of 0.95 g/cm$^3$, a melt flow rate of 0.85 g/10 min as determined by ASTM method D-1238-57T, condition E, and a melting point in the range of 127° to 141° C.

A solution of the ALATHON® 7026 polyethylene was flash-spun from a hot trichlorofluoromethane spin agent. Trichlorofluoromethane boils at about 24° C., has a critical temperature of 198° C., and a critical pressure of 4410 kPa (640 psi). The polyethylene and spin agent solution was mixed in a five gallon autoclave equipped with a motor-driven helical blade agitator, a temperature control, a pressure measuring control, a steam-heated jacket, inlets for loading ingredients, and a discharge line. The discharge line was connected, through a quick acting valve and a jacketed transfer line, to a flash-spinning assembly with 14 spinning nozzles.

The autoclave was opened and 2350 grams of ALATHON® 7026 were added to the clave's mixing chamber at a temperature below about 120° C. The autoclave was closed and evacuated to remove oxygen. Next, 17,230 grams of trichlorofluoromethane spin agent was added, in liquid state, to the clave's mixing chamber through an inlet line. The mixture in the clave comprised 12% polyethylene polymer and 88% spin agent. The agitator mixed the polymer and spin agent as the clave was gradually heated to a temperature of 180° C. over a period of about 1 hour. When the polymer and spin agent reached 180° C., the pressure in the clave was about 10,340 kPa ( about 1500 psi), the polymer was fully dissolved in the spin agent, and the solution displaced the entire capacity of the clave.

At the conclusion of the one hour heating and mixing period, the agitator was stopped and the polymer solution was discharged to the fourteen nozzle spinning assembly. Discharge of the polymer solution was accomplished by opening the discharge line valve and driving the solution out of the clave by introducing Nitrogen into the mixing chamber at a pressure of about 12,065 kPa (about 1750 psi). The polymer solution was directed through the heated transfer line to a distribution channel from which the polymer entered a "coat hanger"-shaped distribution chamber from which the polymer entered the fourteen spin orifices.

Each of the fourteen spin orifices had a tapered inlet through which polymer passed from the distribution chamber to a 0.508 mm (20 mil) orifice through which the solution entered one of fourteen corresponding cylindrically shaped letdown chambers. Each letdown chamber had opposite conically-tapered ends. The end of each letdown chamber proximate the chamber's inlet orifice was conically-tapered at an angle of 60° and the opposite end of each letdown chamber (proximate the spinning orifice) was conically-tapered at an angle of 80°. The straight section of the letdown chamber between the conically-tapered ends had a length of 6.35 cm and a diameter of 10.2 mm. The pressure within the letdown chambers during spinning was about 6757 kPa (980 psi). The polymer and spin agent were discharged from each letdown chamber through each chamber's spinning orifice.

The fourteen spinning orifices were arranged in a straight line and were spaced on 19.05 mm (0.75 in) centers. Each spinning orifice had a diameter of 0.508 mm and a length to diameter ratio of 1. Each spin orifice discharged into a slot like that shown in FIG. 12. The slot had opposite parallel faces spaced 1.106 mm from each other proximate the orifice and proximate the exit opening of the slot. The distance from each spin orifice to the exit opening of the spin pack slot was 9.53 mm along the centerline of polymer flow. The central plane of each slot formed an angle of 25° with the plane passing through the centerline of the fourteen spin orifices.

A finely fibrillated plexifilamentary web was continuously spun from the slots during a production period of approximately 1.5 minutes. The web was laid down directly on a moving belt spaced 20.3 cm (8 in) below the slot openings without passing through an electric corona. The web was initially pinned to the belt with suction and was subsequently stabilized by passing the web through a corona swath charger. The web had a total width of about 33 cm (13 in) with a central 23 cm (9 in) wide portion that had an average basis weight of 54.3 g/m$^2$. The machine direction uniformity of mass deposition was characterized by a coefficient of variation of 0.15 as measured using 1.0 cm$^2$ sample sizes.

It will be apparent to those skilled in the art that modifications and variations can be made in the spin pack apparatus and spinning process of this invention. The invention in its broader aspects is, therefore, not limited to the specific details or the representative apparatus described above. Thus, it is intended that all matter contained in the foregoing description and drawings shall be interpreted as illustrative and not in a limiting sense.

What is claimed is:

1. In a flash-spinning apparatus, a flash spin pack comprising:

a spin pack body;

a spin mixture inlet in said spin pack body;

a spin mixture passage in said spin pack body, said spin mixture passage having first and second ends, said first end of said spin mixture passage being in communication with said spin mixture inlet;

a spinning orifice having a cross-sectional area in the range of 0.0025 mm$^2$ to 32 mm$^2$, said spinning orifice having an inlet and an outlet, the inlet of said spinning orifice being in communication with said second end of said spin mixture passage;

a slot defined by two opposing faces of said spin pack body, the outlet of said spinning orifice opening into said slot, the distance between the opposing faces that define the slot being within the range of 0.25 mm to 7 mm proximate the spinning orifice outlet; and a slot outlet defined by said two opposing faces downstream of said spinning orifice outlet, the distance from said spinning orifice outlet to any portion of said slot outlet being within the range of 1.5 mm to 40 mm, and the distance between the opposing faces at the slot outlet being within the range of 0.25 mm to 10 mm.

2. The flash spin pack of claim 1 further comprising heating elements in said spin pack body for maintaining the temperature of the spin pack body at a desired spinning temperature.

3. The flash spin pack of claim 1 wherein the slot outlet has a substantially semicircular shape that is centered about the spinning orifice outlet.

4. The flash spin pack of claim 3 wherein said spinning orifice has a substantial round cross section with a diameter in the range of 0.5 mm to 1.2 mm.

5. The flash spin pack of claim 4 wherein the opposing faces of said slot diverge from each other at an angle between 0.5° and 5° between the outlet of the spinning orifice and the slot outlet.

6. The flash spin pack of claim 1 wherein said spin pack includes a plurality of spinning orifices having a cross-sectional area in the range of 0.0025 $mm^2$ to 3.0 $mm^2$, each of said spinning orifices having an inlet and an outlet, the inlet of said spinning orifices being in communication with said spin mixture passage;

a plurality of slots, each being defined by two opposing faces of said spin pack body, the outlet of each of said plurality of spinning orifices opening into a different one of said plurality of slots, the distance between the opposing faces that define each slot being within the range of 0.25 mm to 7 mm proximate the spinning orifice outlet; and each of said slots having a slot outlet defined by the two opposing faces downstream of the respective spinning orifice outlet, the distance from each of said spinning orifice outlets to any portion of the respective slot outlet being within the range of 1.5 mm to 40 mm, and the distance between the opposing faces at the slot outlet being within the range of 0.25 mm to 10 mm.

7. The flash spin pack of claim 6 wherein said spinning orifices point in the same direction and are spaced from adjacent orifices at substantially equal intervals along a straight line, wherein each of said plurality of slots defines a central plane that is spaced equally between the opposing faces of the slot, wherein the central plane of each of said slots is substantially parallel to the central planes of the other slots, and wherein the centerline of each spinning orifice is in the central plane of the respective slot.

8. The flash spin pack of claim 7 wherein an angle is formed between the central plane of each of said slots and a plane passing through the centerlines of each of said spinning orifices, and said angle is within the range of 5° to 45°.

9. The flash spin pack of claim 8 wherein the plurality of spinning orifices comprises at least 5 spin orifices.

* * * * *